US009115549B2

(12) United States Patent
Jackson

(10) Patent No.: US 9,115,549 B2
(45) Date of Patent: Aug. 25, 2015

(54) METHOD AND APPARATUS FOR INJECTING GAS INTO A RESERVOIR

(75) Inventor: Steven L. Jackson, Eureka Springs, AK (US)

(73) Assignee: Team Oil Tools, L.P., The Woodlands, TX (US)

( * ) Notice: Subject to any disclaimer, the term of this patent is extended or adjusted under 35 U.S.C. 154(b) by 556 days.

(21) Appl. No.: 13/535,456

(22) Filed: Jun. 28, 2012

(65) Prior Publication Data

US 2014/0000905 A1 Jan. 2, 2014

(51) Int. Cl.

| | |
|---|---|
| ***E21B 43/12*** | (2006.01) |
| ***E21B 34/06*** | (2006.01) |
| ***E21B 33/12*** | (2006.01) |
| ***E21B 17/18*** | (2006.01) |
| ***E21B 33/124*** | (2006.01) |

(52) U.S. Cl.

CPC ..... *E21B 17/18* (2013.01); *E21B 33/124* (2013.01); *E21B 34/063* (2013.01); *E21B 43/122* (2013.01)

(58) Field of Classification Search

CPC ..... E21B 21/10; E21B 43/122; E21B 43/123; E21B 34/10; E21B 34/103; E21B 33/124

See application file for complete search history.

(56) References Cited

U.S. PATENT DOCUMENTS

| | | | | |
|---|---|---|---|---|
| 4,951,750 | A | 8/1990 | Wetzel, Jr. | |
| 6,464,006 | B2 | 10/2002 | Womble | |
| 7,124,831 | B2 | 10/2006 | Turley et al. | |
| 7,766,085 | B2 * | 8/2010 | Stephenson et al. | 166/372 |
| 2011/0005779 | A1 | 1/2011 | Lembcke | |
| 2012/0012306 | A1 | 1/2012 | Treadaway et al. | |
| 2012/0125637 | A1 | 5/2012 | Chenault et al. | |

FOREIGN PATENT DOCUMENTS

| | | |
|---|---|---|
| WO | 2012136960 | 10/2012 |

* cited by examiner

*Primary Examiner* — Nicole Coy

(74) *Attorney, Agent, or Firm* — MH2 Technology Law Group, LLP

(57) ABSTRACT

Methods and apparatuses for single tripping a tool for injecting gas into a reservoir to improve production are shown herein.

8 Claims, 4 Drawing Sheets

METHOD AND APPARATUS FOR INJECTING GAS INTO A RESERVOIR

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

1. Field of the Disclosure

Generally, embodiments of the present disclosure relate to apparatuses and methods injecting fluids into a reservoir. More specifically, embodiments of the present disclosure relate to apparatuses and methods for injecting gas into a reservoir to improve production. More specifically still, embodiments of the present disclosure relate to single trip apparatuses and methods for injecting gas into a reservoir to improve production.

2. Background Art

This section introduces information from the art that may be related to or provide context for some aspects of the technique described herein and/or claimed below. This information is background facilitating a better understanding of that which is disclosed herein. This is a discussion of "related" art. That such art is related in no way implies that it is also "prior" art. The related art may or may not be prior art. The discussion is to be read in this light, and not as admissions of prior art.

Various processes are employed to assist in retrieving oil, water, or a mixture of various fluids from wells when a lack of sufficient reservoir pressure limits well production. One such technique, known as "gas lift," involves injecting a gas into an annulus formed between the well casing and the production tubing within a wellbore. In gas lift wells, gas-lift mandrels having gas-lift valves that are operatively connected thereto are typically installed in the production tubing of the well. Variation between tubing and casing pressures may cause a gas-lift valve to open and close, thereby allowing gas to be injected into the fluid(s) to be retrieved from the well. The injected gas forms air pockets within the fluid and assists in lifting the fluid from the subterranean reservoir and through the wellbore.

In extended reach wells, it may be challenging to produce hydrocarbons from the lowest portion of the reservoir, especially where gas lift valves are not present. In order to increase the production of hydrocarbons from the lowest portions of reservoirs, typically systems involving multiple trips into the well are required. The multiple trips are required to set different types of downhole equipment, such as packers, valves, etc., thereby allowing portions of the well to be isolated, which is required to initiate gas injection.

The presently claimed subject matter is directed to resolving, or at least reducing, one or more of the problems mentioned above.

SUMMARY

In one aspect, embodiments of the present disclosure relate to a downhole tool including a first sealing element and a second sealing element disposed below the first sealing element. The downhole tool further includes an isolation valve disposed below the second sealing element that provides, in use, fluid communication between an area below the second sealing element and a production tube. The downhole tool further includes a cross over disposed above the isolation valve and below the first sealing element that, in use, is in fluid communication with a well.

In another aspect, embodiments of the present disclosure relate to method of injecting gas into a reservoir, the method including running a downhole tool into a well, the downhole tool having a first sealing element, a second sealing element disposed below the first sealing element, an isolation valve disposed below the second sealing element, and a cross over disposed above the isolation valve. The method further including isolating a section of the well between the first and second sealing elements, injecting a first fluid from the isolated section into the cross over, through the isolation valve, and into a second section of the well below the second sealing element, introducing the first fluid into the reservoir; and flowing a second fluid in the reservoir into a production tube through the isolation valve.

In still another aspect, embodiments of the present disclosure relate to method of actuating a downhole tool, the method including running a downhole tool into a well on a tubular, the downhole tool having a first sealing element, a second sealing element disposed below the first sealing element, an isolation valve disposed below the second sealing element, and a cross over disposed above the isolation valve. The method further including pressuring up the tubular to actuate the first sealing element, pressuring up the tubular to actuate the second sealing element, pressuring up the tubular to open the isolation valve, relieving pressure from the tubular, and removing a setting tool from the first sealing element.

The above presents a simplified summary of the presently disclosed subject matter in order to provide a basic understanding of some aspects thereof. The summary is not an exhaustive overview, nor is it intended to identify key or critical elements to delineate the scope of the subject matter claimed below. Its sole purpose is to present some concepts in a simplified form as a prelude to the more detailed description set forth below.

BRIEF DESCRIPTION OF DRAWINGS

The invention may be understood by reference to the following description taken in conjunction with the accompanying drawings, in which like reference numerals identify like elements, and in which.

While the invention is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Illustrative embodiments of the subject matter claimed below will now be disclosed. In the interest of clarity, not all features of an actual implementation are described in this specification. It will be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Figure 1:
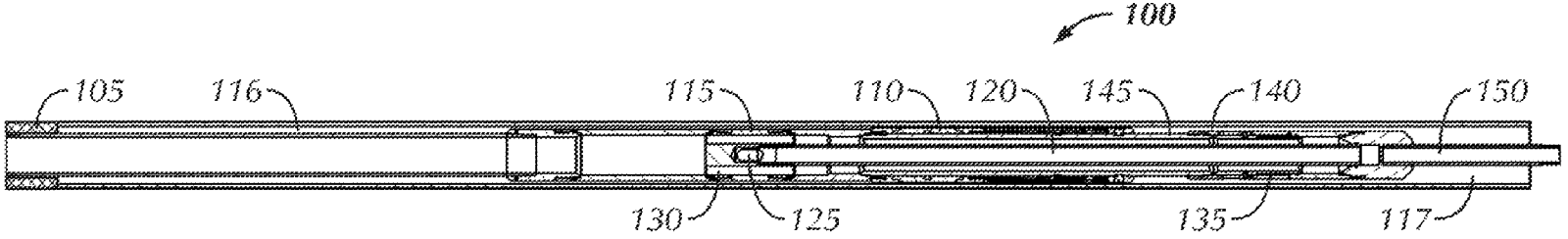
FIG. 1 is a cross-sectional view of one particular embodiment of a downhole tool according to the present disclosure.

Referring now to FIG. 1, a cross-sectional view of a downhole tool 100 according to embodiments of the present disclosure is shown. In this embodiment, the downhole tool 100 includes various components. Downhole tool 100 includes a first sealing element 105 disposed at a proximal end of the downhole tool. First sealing element 105 may include various types of sealing elements 105, such as, for example, packers. Various types of packers may be disposed on downhole tool 100, such as, for example, mechanical or hydraulically actuated packers.

During actuation, first sealing elements 105 may include an elastomeric seal (not independently illustrated) that radially expands into contact with a well wall. As used herein, the term well wall is meant to refer generally to the inner diameter of a wellbore. Those of ordinary skill having the benefit of this disclosure in the art will appreciate that well walls may be lined with casing. Thus, well wall refers generally to the wall of a wellbore, whether the wall is lined/cased or unlined/uncased.

First sealing element 105 may be disposed at various distances from other components of downhole tool 100, and the placement of first sealing element 105 may be determined, at least in part, on the location of gas lift lines (not illustrated) within the well. In certain embodiments, first sealing element 105 may be tens or even hundreds of feet from other components of the downhole tool 100.

Downhole tool 100 further includes a second sealing element 110 disposed at a distal end of downhole tool 100. As with first sealing element 105, second sealing elements 110 may include various types of sealing elements, such as, for example, packers. Second sealing elements 110 may be actuated to expand into contact with the well wall, and in combination with first sealing elements 105 may be actuated to isolate a section of the well. Actuation of the first sealing element 105 and the second sealing element 110 may form an annular area 116 between the sealing elements 105/110. The annular area 116 may receive fluids, such as gas from the aforementioned gas lift lines. The use of such gas according to embodiments of the present disclosure is discussed in greater detail below.

Downhole tool 100 further includes cross over 115, which is configured to allow fluid communication between a well and an inner concentric tube 120 of the downhole tool 100. Cross over 115 includes one or more ports 125 that allow fluids, such as an injected gas, to flow from an annulus formed between downhole tool 100 and the well wall into the concentric tube 120. Ports 125 may be of any geometry such as, for example, circular, oval, rectangular, or otherwise. Cross over 115 further includes one or more drill holes 130, which may allow fluids to flow from the reservoir, through the drill holes 130 and into the production string (not illustrated).

An isolation valve 135 is disposed on downhole tool 100 below cross over 115 and second sealing element 110. Isolation valve 135 includes one or more isolation ports 140, that are configured to provide fluid communication between the reservoir and the production string (not illustrated). Thus, after actuation, fluids, such as hydrocarbons, may flow from the reservoir those isolation ports 140, into internal conduits 145, through drill holes 130 of the cross over 115 and into a production string. Actuation of isolation valve 135 is discussed in detail below.

Downhole tool 100 further includes an umbilical tube 150 disposed at a distal end of the downhole tool 100. Umbilical tube 150 is connected to downhole tool 100, thereby allowing fluid communication from the cross over 115. During a gas lift operation, gas may flow into cross over 115, down concentric tube 120, through umbilical tube 150 and into the reservoir. Umbilical 150 may be formed from various metals, metal alloys, and/or composites. The length of umbilical 150 may depend on the distance between the downhole tool 100 and the reservoir. Because the reservoir may be located hundreds of feet from the location of downhole tool 100, the umbilical tube 150 length may be adjusted accordingly. The placement of umbilical tube 150 in well, results in an annular area 117 between umbilical tube 150 and the well wall. Produced fluids may thereby flow into annular area 117 during gas assisted production, as will be described in greater detail below.

Figure 2:
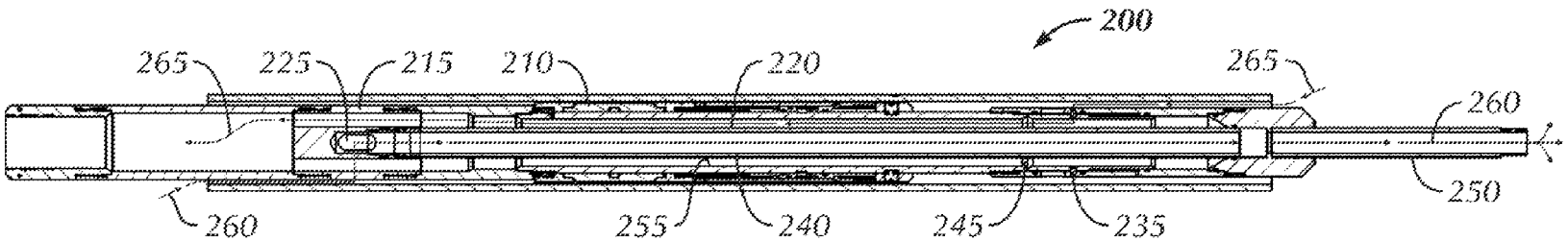
FIG. 2 is a cross-sectional view of a second embodiment of a downhole tool according to the present disclosure.

Referring to FIG. 2, a cross-sectional view of downhole tool 200 according to embodiments of the present disclosure is shown. In this embodiment, downhole tool 200 is shown in close perspective to illustrate the flow of fluids within the tool after the tool has been run-in-hole and actuated. Actuation of downhole tool 200 and the individual components will be discussed in detail below.

After downhole tool 200 is run-in-hole and actuated (i.e., the sealing elements have isolated a section of the well, fluid communication is provided between cross over 215 and the isolated section, and fluid communication is provided between the isolation valve 235 and the reservoir) gas may be injected from a gas lift line (not shown), which is installed in the well, into the reservoir. For clarity, the injected fluid, i.e., gas, is illustrated as reference character 260, which the second fluid, i.e., the produced hydrocarbons, is illustrated as reference character 265.

Gas is pumped from a gas lift line and fills an annular area in the isolated section between the downhole tool 200 and the well wall. Gas then enters the cross over 215 through ports 225 gas continues to flow down concentric tube 220 and through isolation valve 235. The gas passes through isolation valve 235 and flows down umbilical tube 250 until the gas reaches the formation, at which point the gas exits the umbilical tube 250 into the reservoir.

The gas lifts production fluids from the reservoir into the annular area outside the umbilical tube 250 and the well wall. The production fluids is lifted up through isolation ports 245 of the isolation valve 235, through the internal conduits 240 (which may be the annular area formed between the concentric tube 220 and the wall 255 of the downhole tool 200) and into the cross over 215. The produced fluids flow through the drill holes 230 of the cross over 215, through the inner diameter of the first sealing element (not shown) to the surface.

In order to more fully explain the operation of the downhole tool, various components of the downhole tool will be discussed in detail.

Figure 3:
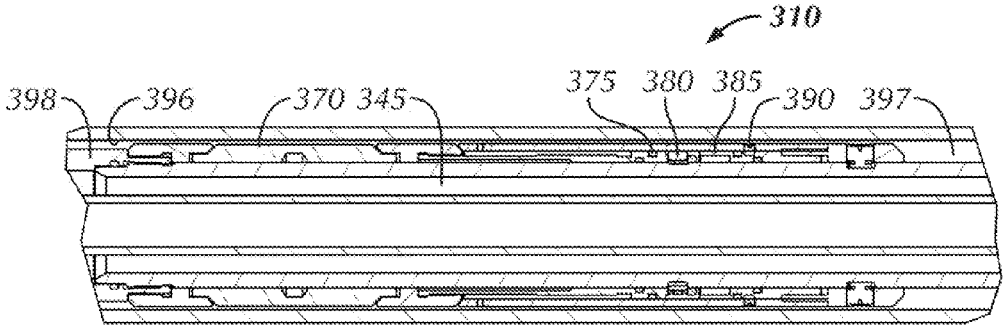
FIG. 3 is a fragmented, cross-sectional view of one particular embodiment of a sealing element usable in various embodiments such as those disclosed in FIG. 1-FIG. 2.

Referring to FIG. 3, a cross-sectional view of the second sealing element 310 according to embodiments of the present disclosure is shown. FIG. 3 shows second sealing elements 310 as it is run-in-hole, prior to actuation. As the downhole tool is run-in-hole, a radially expandable sealing portion 370 of the second sealing element 310 is radially constricted. Second sealing elements 310 includes radially expandable sealing portion 370, a setting piston 375, an anti-preset key 380, an anti-preset piston 385, and one or more shear screws 390. As the downhole tool is run-in-hole, the anti-preset keys 380 and anti-preset piston 385 prevent the second sealing elements 310 from prematurely expanding.

During actuation of second sealing elements 310, pressure is increased in internal conduits 345. The pressure differential between internal conduit 345 and the well shears the one or more shear screws 390. When the shear screws 390 break, the anti-preset piston 385 moves axially downward, thereby unlocking the anti-preset keys 380. Unlocking the anti-preset keys 380 allows the setting piston 375 to stroke axially upward, thereby setting packer, i.e., radially expanding radially expandable sealing portion 370. Radial expansion of radially expandable sealing portion 370 causes the radially expandable sealing portion 370 to contact the well wall 396, isolating an area of the well above and below the second sealing element 310. Thus, after actuation, separate annular areas are created above and below the radially expandable sealing portion 370. A lower well area 397 is created below radially expandable sealing portion 370, and an upper well area 398 is created above radially expandable sealing portion 370.

While not explicitly explained herein, the first sealing element (105 of FIG. 1) may be actuated in substantially the same way. Those of ordinary skill in the art having the benefit of this disclosure will appreciate that other methods of actuating either the first or second sealing elements may also be used, for example, though mechanical setting. Additionally, the order in which the first and second sealing elements are set may vary according to the requirements of the production operation. In certain embodiments, the first sealing element may be set first, which in alternative embodiments the second sealing elements may be set first.

Figure 4:
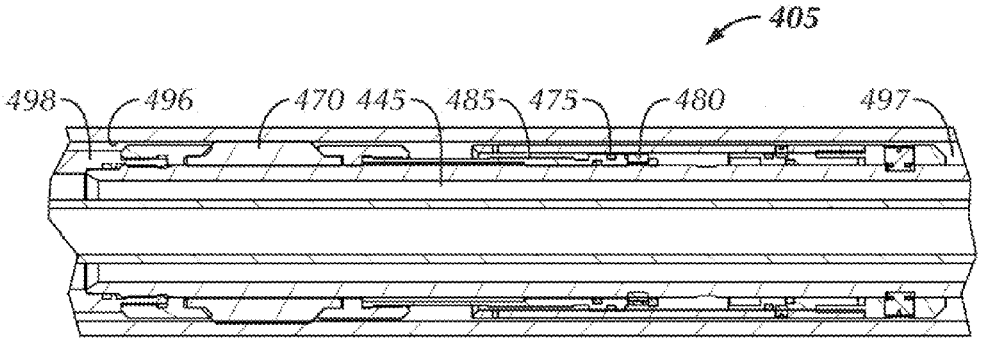
FIG. 4 is a fragmented, cross-sectional view of a second embodiment of a sealing element usable in various embodiments such as those disclosed in FIG. 1-FIG. 2.

Referring now to FIG. 4, a cross-sectional view of the second sealing element 405 according to embodiments of the present disclosure is shown. In FIG. 4, second sealing elements 405 is illustrated after being actuated. As with the second sealing elements described above in FIG. 3, second sealing elements 405 includes a setting piston 485, as well as an anti-preset key 475, and an anti-preset piston 480. As illustrated, the setting piston 485 has stroked axially upward due to the pressure differential between the internal conduit 445 and the well. The upstroke of the setting piston 485 pushes against the radially expandable sealing portion 470, thereby expanding the radially expandable sealing portion 470 into contact with the well wall 496.

After actuation of second sealing elements 405, a lower well area 497 is created below radially expandable sealing portion 470, and an upper well area 498 is created above radially expandable sealing portion 470. Those of ordinary skill in the art having the benefit of this disclosure will appreciate that the first sealing elements (105 of FIG. 1) could actuate the same way, thereby isolating the area between the two sealing elements, i.e., 498. The isolated area of the well will be described in greater detail below.

Figure 5A:
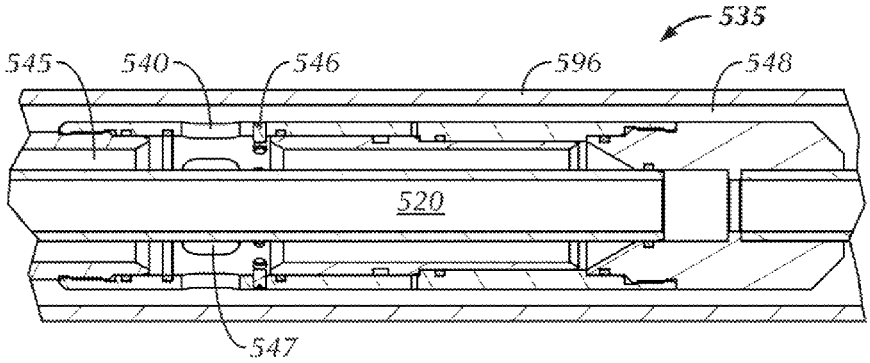
FIG. 5A-FIG. 5B are a cross-sectional and an isometric view, respectively, of one particular embodiment of an isolation valve usable in various embodiments such as those disclosed in FIG. 1-FIG. 2.
Figure 5B:
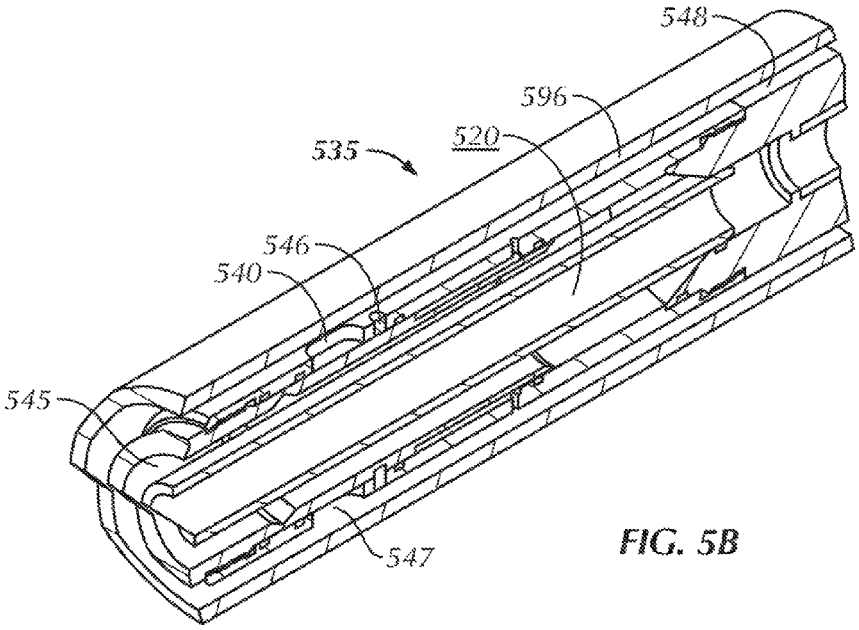

Referring to FIGS. 5A and 5B, cross-sectional and isometric views, respectively, of the isolation valve 535 according to embodiments of the present disclosure are shown. After the first and second sealing elements (105 and 110 of FIG. 1) are set, the isolation valve 535 may be set by continuing to increase the pressure in internal conduit 545. By increasing the differential pressure between the internal conduit 545 and the well (as constricted by the well wall 596), isolation valve shear screws 546 may be sheared, thereby allowing the isolation valve 535 to open. Opening the isolation valve may occur by aligning an isolation port 540 with one or more apertures 547 of the isolation valve 535. The isolation port 540 and the apertures 547 may be aligned by rotating either the isolation port or the aperture 547 into alignment, thereby providing fluid communication between the annulus 548 between the well wall 596 and the isolation valve 535. In alternative embodiments, the isolation port 540 and apertures 547 may be aligned through axial movement of one or both of the isolation port 540 and/or the apertures 547.

During production, produced fluids, such as hydrocarbons may be lifted through annulus 548, through port 540 and apertures 547 and into internal conduit 545. The produced fluids may continue to flow upward to the surface. Also, during production, gas may be injected downward through concentric tube 520 through isolation valve 535 and down to the reservoir.

Figure 6A:
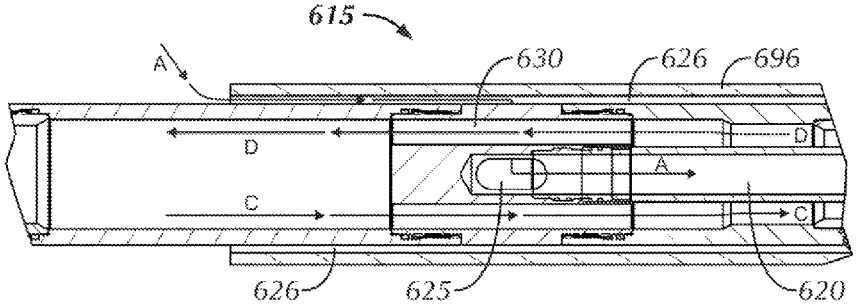
FIG. 6A-FIG. 6B are a cross-sectional and an isometric view, respectively, of one particular embodiment of a cross over usable in various embodiments such as those disclosed in FIG. 1-FIG. 2.
Figure 6B:
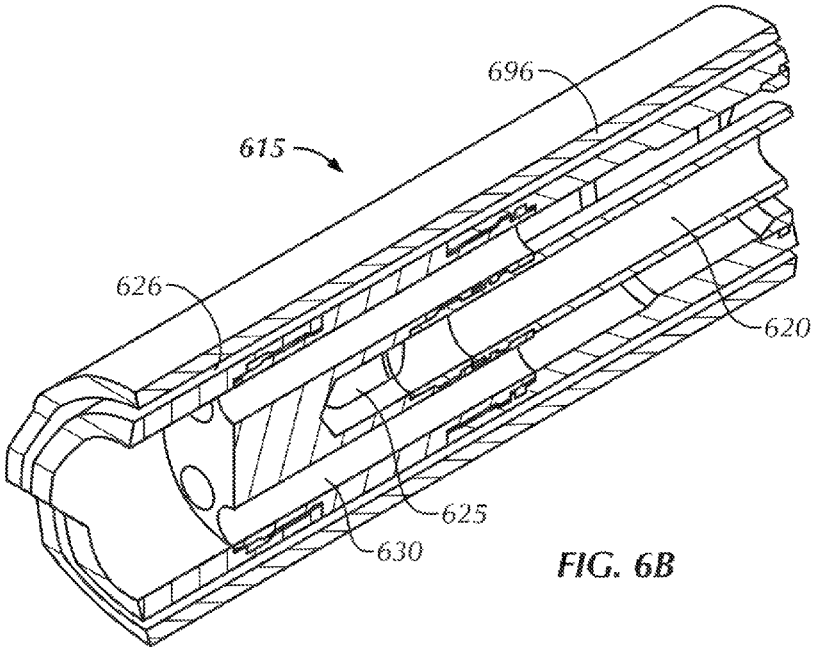

Referring to FIGS. 6A and 6B, cross-sectional and isometric view, respectively, of the cross over 615 according to embodiments of the present disclosure are shown. Cross over 615 includes a port 625 that provides fluid communication between an annulus 626 formed between the well wall 696 and crossover 615. The port 625 thereby allows gas to be injected from a gas lift valve (not shown) into the annulus 626, through the port 625 and into the concentric tube 620 (illustrated as flow path A).

Prior to actuating the downhole tool, cross over 615 allows fluid to be pumped downhole from the surface, through drill holes 630 to build pressure in the downhole tool. By pumping fluid downhole, a pressure differential is created between the downhole tool and the well, thereby allowing the sealing elements and the isolation valve to actuate, as explained in detail below. After the downhole tool is actuated, cross over 615 allows for fluid communication between the reservoir and the production string (not shown). These flow channels are depicted as flow paths C and D, respectively. Those of ordinary skill in the art having the benefit of this disclosure will appreciate that fluid will flow through cross over 615 in either direction C or D, not both at the same time. Thus, prior to setting the tool, fluid flows in direction C and after setting the tool, fluid flows in direction D.

Embodiments of the downhole tool described above may be used in production operations in order to increase the production of, for example, hydrocarbons from a well. Those of ordinary skill in the art having the benefit of this disclosure will appreciate that in certain embodiments, the downhole tool described above may be used to increase the production of various fluids from wells. Methods for deploying downhole tools according to embodiments of the present disclosure are described in detail below.

In embodiment the downhole tool described above may be used to increase the production of fluids from a well by injecting gas into a reservoir. In such an embodiments, the method includes running a downhole tool into a well. The downhole tool may include, for example, a first sealing element, such as a packer, as well as a second sealing element disposed lower on the downhole tool than the first sealing elements. The downhole tool further includes an isolation valve disposed below the second sealing element, as well as a cross over disposed above the isolation valve. Those of ordinary skill in the art having the benefit of this disclosure will appreciate that the elements as described herein may include the downhole tool described above, as well as include other components typically associated with downhole production strings.

The downhole tool may be run into the well at various depths according to the production zones of the well. In one embodiment, the downhole tool may be run into a wellbore such that a gas lift line is located between the first and second sealing elements. Thus, by subsequent actuation of the sealing elements, a section of the wellbore between the first and second sealing elements may be isolated from a section of the wellbore above the first sealing element and a section of the wellbore below the second sealing elements. In certain embodiments, multiple downhole tools, such as those described above, may be run in a single production string, thereby allowing multiple sections of the wellbore to be isolated.

After the downhole tool is run into the well, a section of the well between the first and second sealing elements may be isolated. In order to isolate the section of the well, the first and second sealing elements may be set. Those of ordinary skill in the art having the benefit of this disclosure will appreciate that the first and second sealing elements may be set various ways including, for example, mechanical or hydraulic setting. As described above, in one embodiment, a fluid is pumped downhole into the downhole tool. The pressure differential created between the inner components of the downhole tool and the well may causes one or more shear pins to break, thereby setting one or more of the first and second sealing elements. The pressure used to actuate the first and second sealing elements may vary based on the requirements of the operation, but may including pressures in a range of, for example, 3000 psi to 10000 psi.

Depending on the requirements of the production operation, the first and second sealing elements may be set in any order. For example, in one embodiment, the first sealing element, located axially proximate the surface may be set first, then the second sealing element may be subsequently set. In another embodiment, the second sealing element, located distally on the downhole tool may be set first, then the first sealing element may be subsequently set. The order of setting the sealing elements may be adjusted according to specific requirements of a particular well.

As described above, the first and second sealing elements may be configured to actuate at different pressures. Thus, pressure may be increased to a first level to set one of the sealing elements, while the pressure may be increased further to set the other sealing element. Additionally, the pressure may be increased even further to open the isolation valve. Thus, in one trip, the sealing elements and isolation valve may be actuated and the downhole tool may be set and ready for gas injection.

At this point, a setting tool of the downhole tool may be disconnected from the downhole tool and returned to the surface. Those of ordinary skill in the art having the benefit of this disclosure will appreciate that disconnecting the setting tool may occur by rotating the setting tool off of the downhole tool by, for example, right hand rotation of the setting tool.

After the first and second sealing elements are actuated and a section of the well is isolated, a first fluid may be injected from the isolated section of the well. The fluid, such as a gas, may be injected through gas lift lines that are installed in the well prior to the downhole tool being run into the well. The gas lift lines may include one or more ports in the casing through which gas is provided from the surface to the isolated section of the well.

By injecting the first fluid into the well, the first fluid is allowed to flow into the cross over of the downhole tool. The first fluid continues to flow through the cross over, through the isolation valve and into a second section of the well located below the sealing element. The first fluid continues down the umbilical tube until the umbilical tube terminates, at which point the first fluid exits the umbilical tube into the well.

As the first fluid flows into the well, the fluid contacts the reservoir, and forces a second fluid, such as a hydrocarbon fluid (e.g., oil, gas, etc.) upward in the well. The second fluid is then flowed from the reservoir, upward in the well, into the isolation valve. The fluid continues to flow through the downhole tool axially upward until the fluid enters a production tubing, at which point the fluid may be flowed to the surface.

As previously explained, embodiments of the present disclosure may be used to set the downhole tool and allow gas injection in a single trip. The actuation steps of deploying the downhole tool will be discussed in detail below.

In one embodiment, a downhole tool according to embodiments of the present disclosure may be run into a well on a tubular. The tubular may include various components, such as production tubing and setting tools. The downhole tool may include, for example, a first sealing element and a second sealing elements disposed axially below the first sealing elements. The downhole tool may further include an isolation valve disposed below the second sealing element, as well as a cross over disposed above the isolation valve.

After the downhole tool is run into the well, hydraulic pressure may be provided through the tubular, thereby increasing the pressure in the tubular. When the tubular is pressured up to a predefined pressure point (i.e., the point at which a shear pin is configured to shear), the first sealing element may be actuated by, for example, shearing a pin in the downhole tool. The shear pin may break due to the difference in the pressure between the tubular and the well. To further explain actuation of the first sealing element, as a pressure differential is created between the tubular and the well wall, the shear pin shears, thereby allowing a setting piston of the first sealing elements to stroke upward. The upward stroke of the setting piston cases the sealing elements to radially expand into contact with the well wall.

After the first sealing element is actuated, pressure may be further increased to a specified point, at which point the second sealing element may be actuated. As with the first sealing element, the second sealing element may be actuated due to the difference in the pressure between the tubular and the well.

After the first and second sealing elements are actuated and a section of the well is isolated between the first and second sealing elements, pressure may be further increased within the tubular. By pressuring up the tubular further, the isolation valve may be opened, thereby providing fluid communication between the downhole tool and the reservoir.

Those of ordinary skill in the art having the benefit of this disclosure will appreciate that multiple shear pins may be used on each of the first and second sealing elements, as well as the isolation valve. Additionally, the shear pins of each of the different components may be configured to shear at different pressures. Thus, each tool may be configured to actuate at a different pressure, preventing premature actuation of a tool. In this embodiment, three different pressure shear pins are used, however, those of ordinary skill in the art having the benefit of this disclosure will appreciate that in alternative embodiments, more than three different shear pins may be used, thereby allowing more than three components to individually actuate.

After the downhole tool is actuated, pressure may be relieved from the tubular and the setting tool may be removed from the first sealing element or the portion of the downhole tool to which the setting tool is connected.

Thus, as described above, some embodiments of the present disclosure may provide downhole tools that may be run into a well and actuated in a single trip. Because multiple trips in a well are expensive, especially in deep wells, these embodiments may decrease costs associated with producing a well. Furthermore, some embodiments may provide downhole tools that allow a well to be isolated in a single trip, thereby allowing a gas injection operation to commence after the downhole tool is disposed in the wellbore without requiring multiple trips.

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A method of actuating a downhole tool, the method comprising:

running a downhole tool into a well, the downhole tool comprising:

a first sealing element;

a second sealing element disposed below the first sealing element;

an isolation valve disposed below the second sealing element; and a cross over disposed above the isolation valve;

actuating the first sealing element, wherein the actuating the first sealing element comprises:

creating a pressure differential between a tubular and a well wall of the well;

upwardly stroking a setting piston of the downhole tool; and radially expanding the first sealing element into contact with the well wall;

actuating the second sealing element;

opening the isolation valve; and removing a setting tool from the first sealing element.

2. The method of claim 1, wherein actuating the second sealing element comprises:

creating a second pressure differential between the tubular and the well wall;

stroking a second setting piston of the downhole tool upward; and radially expanding the second sealing element into contact with the well wall.

3. The method of claim 2, wherein actuating the isolation valve comprises:

creating a third pressure differential between the tubular and the well wall; and shearing at least one shear screw disposed on the isolation valve.

4. The method of claim 1, further comprising relieving pressure from the tubular in fluid communication with the downhole tool.

5. The method of claim 1, wherein the actuating the first sealing element, the actuating the second sealing element, and the actuating the isolation valve occur in a single trip into the well.

6. The method of claim 1, wherein opening the isolation valve comprises causing a sleeve to move from a closed position to an open position, wherein the sleeve in the closed position blocks a port, and the sleeve in the open position allows fluid communication from an outer annulus between the downhole tool and the well wall to an inner flowpath at least partially within the downhole tool, via the port.

7. The method of claim 6, wherein the inner flowpath is at least partially defined on a radial inside by an inner conduit, the inner flowpath fluidly communicating with a first flowpath through the cross over, and wherein an interior of the inner conduit communicates with a second flowpath through the cross over, the first and second flowpaths being isolated from one another.

8. The method of claim 7, wherein causing the sleeve to move comprises applying a pressure to the inner flowpath, and wherein the sleeve is in pressure communication with the outer annulus, such that the pressure differential is applied across the sleeve, causing the sleeve to move.

* * * * *